US009964119B2

(12) United States Patent
Lin et al.

(10) Patent No.: US 9,964,119 B2
(45) Date of Patent: May 8, 2018

(54) CENTRIFUGAL FAN

(71) Applicant: DELTA ELECTRONICS, INC., Taoyuan Hsien (TW)

(72) Inventors: Hsin-Chen Lin, Taoyuan Hsien (TW); Hsiang-Jung Huang, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 201 days.

(21) Appl. No.: 14/582,213

(22) Filed: Dec. 24, 2014

(65) Prior Publication Data

US 2015/0110615 A1 Apr. 23, 2015

Related U.S. Application Data

(63) Continuation of application No. 13/283,614, filed on Oct. 28, 2011, now Pat. No. 8,967,962.

(30) Foreign Application Priority Data

Dec. 14, 2010 (TW) ..... 099143623 A

(51) Int. Cl.
*F04D 29/42* (2006.01)
*F04D 29/44* (2006.01)
(Continued)

(52) U.S. Cl.
CPC ..... *F04D 29/4206* (2013.01); *F04D 17/08* (2013.01); *F04D 17/16* (2013.01);
(Continued)

(58) Field of Classification Search
CPC ..... F04D 29/40; F04D 29/403; F04D 29/42; F04D 29/4206; F04D 29/4213;
(Continued)

(56) References Cited

U.S. PATENT DOCUMENTS 3,447,475 A 6/1969 Blum
3,659,955 A 5/1972 Schonwald
(Continued)

FOREIGN PATENT DOCUMENTS

CN 1959126 A 5/2007
CN 101025165 A 8/2007
(Continued)

OTHER PUBLICATIONS

Machine translation of DE 2633781 A1 (Feb. 2, 1978) from Espacenet.*
Maryland Metrics, Surface Roughness Tables, copyright 1998.

*Primary Examiner* — Jason Shanske
*Assistant Examiner* — Christopher R Legendre
(74) *Attorney, Agent, or Firm* — CKC & PARTNERS CO., LTD.

(57) ABSTRACT

A centrifugal fan includes a housing and an impeller. The housing includes a first surface and a flow channel wall. The first surface has a surrounding section and an air inlet section. The surrounding section encircles the air inlet section. The flow channel wall defines a flow chamber and an air outlet, and at least a sidewall of the flow channel wall has a tongue portion close to the air outlet. The impeller is rotatably connected within the flow chamber. The surrounding section plus the air inlet section is an area on the first surface, on which the impeller is projected, and the surrounding section has a convex structure.

3 Claims, 6 Drawing Sheets

(51) Int. Cl.
*F04D 17/16* (2006.01)
*F04D 25/06* (2006.01)
*F04D 17/08* (2006.01)

(52) U.S. Cl.
CPC ..... *F04D 25/0613* (2013.01); *F04D 29/422* (2013.01); *F04D 29/424* (2013.01); *F04D 29/4226* (2013.01); *F04D 29/441* (2013.01)

(58) Field of Classification Search
CPC ..... F04D 29/422; F04D 29/4226; F04D 29/4233; F04D 29/424; F04D 29/441
USPC ..... 415/182.1, 203, 204, 206, 224, 224.5
See application file for complete search history.

(56) References Cited

U.S. PATENT DOCUMENTS 3,730,642 A 5/1973 Barnstead et al.
4,432,694 A 2/1984 Kuroda et al.
4,917,572 A 4/1990 Van Houten
5,030,062 A 7/1991 Sutton
5,997,246 A * 12/1999 Humbad ..... F04D 29/667 415/119
6,754,075 B2 6/2004 Boucheret et al.
7,284,952 B2 10/2007 Huang et al.
7,329,095 B2 2/2008 Wang
7,476,076 B2 1/2009 Shimada
7,891,942 B2 * 2/2011 Hsu ..... F04D 29/162 415/184
8,072,101 B2 12/2011 Ho
8,794,915 B2 8/2014 Yamashita et al.
8,967,962 B2 * 3/2015 Lin ..... F04D 17/16 415/206
9,206,813 B2 * 12/2015 Lin ..... F04D 25/08
2007/0128052 A1 6/2007 Moriya et al.
2009/0067991 A1 3/2009 Hwang
2009/0104031 A1 * 4/2009 Hwang ..... F04D 29/4213 415/203
2012/0148393 A1 6/2012 Lin et al.
2012/0148394 A1 6/2012 Lin et al.
2013/0115066 A1 5/2013 Lin et al.
2014/0178194 A1 6/2014 Tamaoka et al.

FOREIGN PATENT DOCUMENTS

CN 101413515 A 4/2009
DE 2633781 A1 * 2/1978 ..... F04D 29/4213
EP 0501198 B1 9/1992
JP 10054388 A 2/1998
JP 2009114906 A 5/2009

* cited by examiner

CENTRIFUGAL FAN

RELATED APPLICATIONS

This application is a Continuation Application of U.S. application Ser. No. 13/283,614, filed on Oct. 28, 2011, which claims priority of Taiwanese Patent Application No. 099143623, filed on Dec. 14, 2010, the entirety of which is incorporated by reference herein.

BACKGROUND

Technical Field

The present invention relates to a fan. More particularly, the present invention relates to a centrifugal fan.

Description of Related Art

The centrifugal fans are different from the axial fans in that the centrifugal fans' air inlet and outlet are not both located along an axial direction of its impeller. The centrifugal fans intakes air along an axial direction of the impeller and outputs air along a radial direction of the impeller.

Due to the centrifugal fan's characteristics, part of airflows within the fan housing leak through the air inlets. In particular, airflows within the pressure-enhanced section are equipped with higher pressures and tend to be leaked through the gaps between the impeller and an upper or lower housing, thereby resulting in a lower output air pressure and centrifugal fan's poor performance.

For the foregoing reasons, there is a need for preventing the centrifugal fan's air-leaking through air-inlets.

SUMMARY

According to one aspect of the present invention, a centrifugal fan includes a housing and an impeller. The housing includes a first surface and a flow channel wall. The first surface has a surrounding section and an air inlet section. The surrounding section encircles the air inlet section. The flow channel wall defines a flow chamber and an air outlet, and at least a sidewall of the flow channel wall has a tongue portion close to the air outlet. The impeller is rotatably connected within the flow chamber. The surrounding section plus the air inlet section is an area on the first surface, on which the impeller is projected, and the surrounding section has a convex structure.

According to an embodiment disclosed herein, the convex structure is disposed within a pressure-enhanced section of the centrifugal fan.

According to another embodiment disclosed herein, the convex structure includes a plurality of convex members.

According to another embodiment disclosed herein, the convex members include circular, rectangular or wedged-shaped convex members.

According to another embodiment disclosed herein, the convex structure includes a plurality of arc-shaped convex ribs extending radially from an outmost edge of the air inlet section.

According to another embodiment disclosed herein, the convex structure includes a plurality of arc-shaped convex ribs that are in parallel with an outmost edge of the air inlet section.

According to another embodiment disclosed herein, the convex structure includes a convex bulk member that has an inclined surface facing the flow channel wall.

According to another aspect of the present invention, a centrifugal fan includes a housing and an impeller. The housing includes a first surface and a flow channel wall. The first surface has a surrounding section and an air inlet section. The surrounding section encircles the air inlet section. The flow channel wall defines a flow chamber and an air outlet, and at least a sidewall of the flow channel wall has a tongue portion close to the air outlet. The impeller is rotatably connected within the flow chamber. The surrounding section plus the air inlet section is an area on the first surface, on which the impeller is projected, the surrounding section has a plurality of sub-sections, at least two of which are equipped with different average roughness.

According to an embodiment disclosed herein, the surrounding section is equally divided into eight sub-sections using an rotation axis of the impeller as a center, the at least two sub-sections has respective average roughness different from each other by more than 1.6 μm.

According to another aspect of the present invention, a centrifugal fan includes a housing and an impeller. The housing includes a first surface and a flow channel wall. The first surface has a surrounding section and an air inlet section. The surrounding section encircles the air inlet section. The flow channel wall defines a flow chamber and an air outlet, and at least a sidewall of the flow channel wall has a tongue portion close to the air outlet. The impeller is rotatably connected within the flow chamber. The surrounding section plus the air inlet section is an area on the first surface, on which the impeller is projected, the surrounding section has a pressure-increased structure to reduce air-leaking through the air inlet section.

According to an embodiment disclosed herein, an angle region of the pressure-enhanced section is ⅔ of the angle region between the tongue portion and a terminal end of the flow channel wall.

Thus, the centrifugal fan is equipped with the special design on the surrounding section around the air inlet section (within the housing) such that when the impeller rotates, at least two surface designs or surface roughness generate different airflow resistances. With this regard, airflows within the pressure-enhanced section of the centrifugal fan are less likely to leak through the air inlets, thereby reducing an air flowing friction of the air outlet and improving the centrifugal fan's performance, e.g. output air pressure and volume.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

Figure 1:
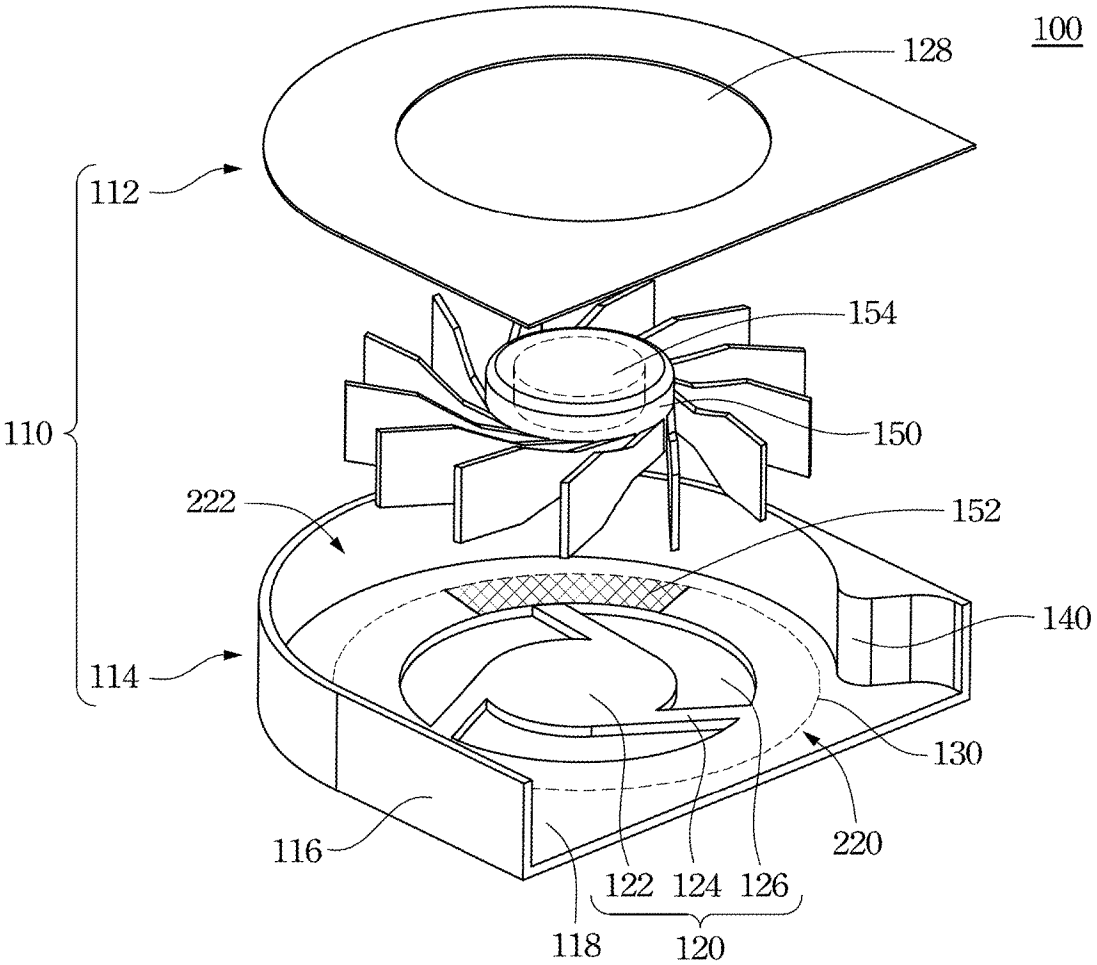
FIG. 1 illustrates an exploded view of a centrifugal fan according to one preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

The present invention provides a centrifugal fan, which has a special design on a surrounding section around the air inlet section, to reduce the possibility of air-leaking through the air inlets and an air flowing friction of the air outlet and enhance the centrifugal fan's performance, e.g. output air pressure and volume.

Referring to FIG. 1, it illustrates an exploded view of a centrifugal fan according to one preferred embodiment of this invention. The centrifugal fan 100 includes a housing 110 and an impeller 150. The housing 110 consists of an upper housing 112 and a lower housing 114. In this embodiment, the first surface is a bottom surface 118 of the lower housing 114. In other embodiment, the first surface can be a surface of the upper housing 112, which is equipped with an air inlet section 128. The lower housing 114 has a bottom surface 118 and a flow channel wall 116. The bottom surface 118 has a surrounding section 130 and an air inlet section 120. The surrounding section 130 encircles the air inlet section 120. In this embodiment, the air inlet section 120 has a central board 122 and multiple ribs 124, which collectively define air inlets 126 among the ribs 124 and the central board 122. The ribs 124 and central board 122 can enhance the lower housing 114's strength.

The flow channel wall 116 defines a flow chamber 222 and an air outlet 220. At least a sidewall of the flow channel wall has a tongue portion 140 (a convex member on the flow channel wall) close to the air outlet 220. The impeller 150 is rotatably connected with the central board 122 and driven by a motor 154 to rotate within the flow chamber 222, thereby generating airflows. The surrounding section 130 plus the air inlet section 120 is an area on the first surface, on which the impeller 150 is projected. That is, the surrounding section 130 is the section, which the projected area (on the bottom surface) of the impeller 150 deducts the air inlet section 120. The surrounding section 130 has a special surface design, e.g. a convex structure 152 in this embodiment.

Figure 2:
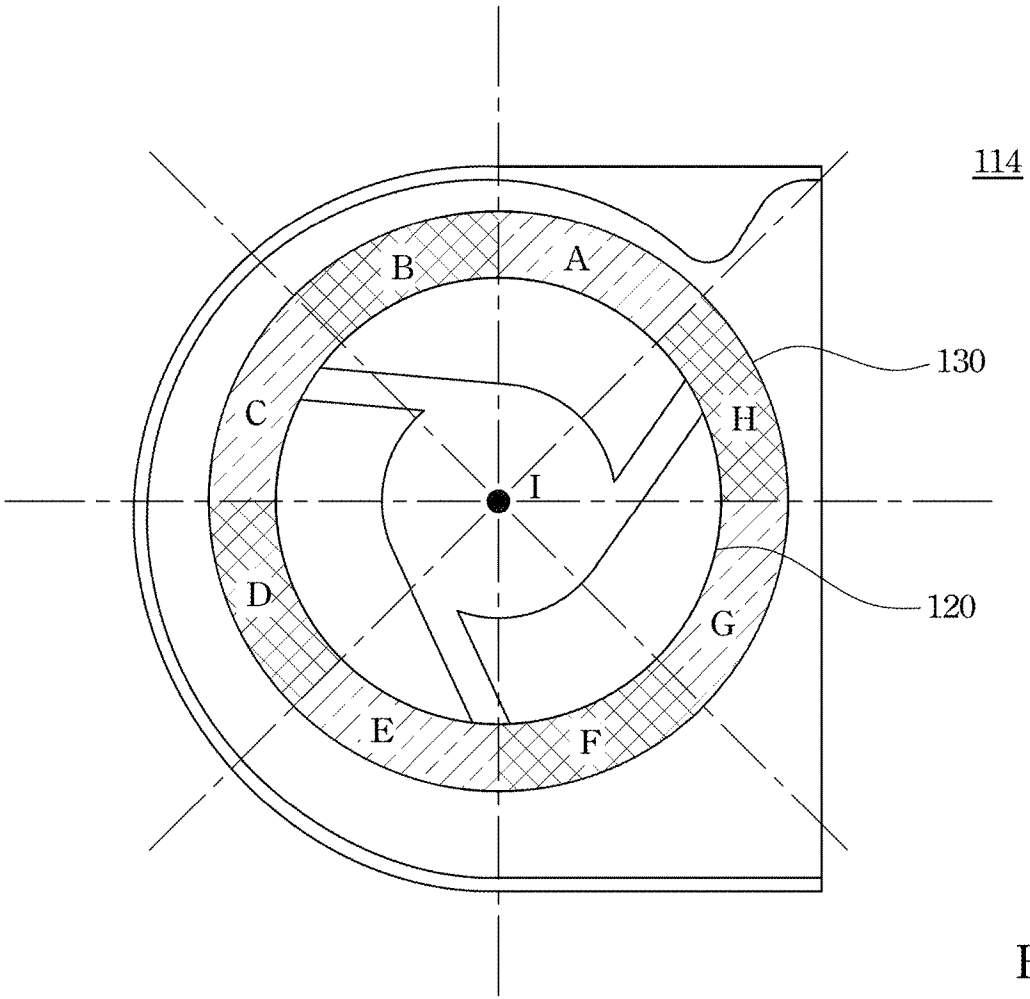
FIG. 2 illustrates a top view of a lower housing of the centrifugal fan according to one preferred embodiment of this invention.

This special surface design is equipped with an average roughness different from that of the other sections on the surrounding section 130. In particular, the surrounding section 130 has a plurality of sub-sections, of which at least two sub-sections are equipped with different average roughness (Ra). Referring to FIG. 2, it illustrates a top view of a lower housing of the centrifugal fan according to one preferred embodiment of this invention. The surrounding section 130 is equally divided into eight sub-sections (A-H) using a rotation axis (I) of the impeller as a center, the at least two sub-sections has respective average roughness different from each other by more than 1.6 μm. With this regard, when the impeller rotates 360 degrees, two different surfaces (equipped with two different average roughness) generate two different flow resistances so as to enhance the centrifugal fan's performance.

In this embodiment, an air flowing channel (i.e. an air flowing route within the flow chamber) of the centrifugal fan can be divided into a pressure-enhanced section and an air output section. When the special structure, i.e. the convex structure, is designed on the pressure-enhanced section, it can reduce the possibility of air-leaking through the air inlets.

Figure 3B:
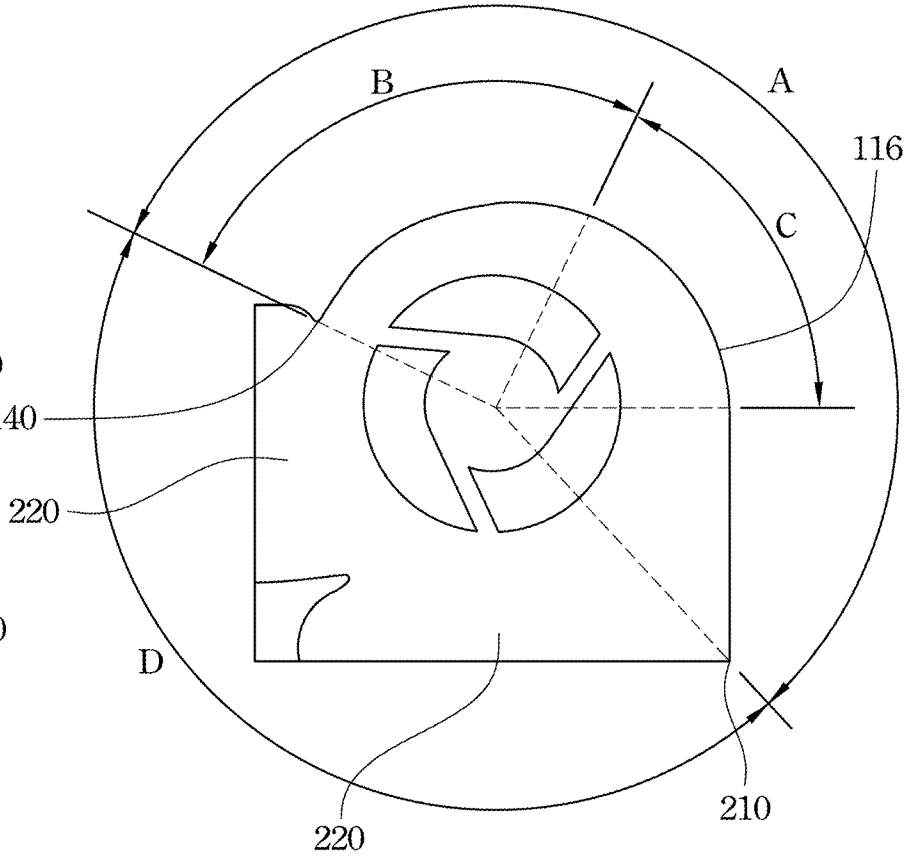
FIG. 3A and FIG. 3B respectively illustrate a top view of a lower housing of the centrifugal fan according to one preferred embodiment of this invention.
Figure 3A:
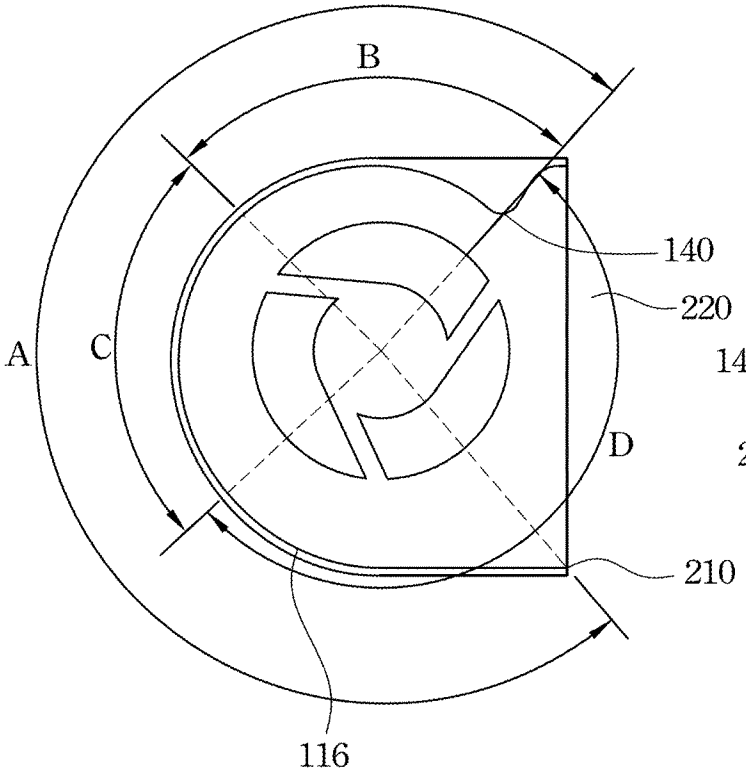

Referring to FIGS. 3A and 3B, they respectively illustrate a top view of a lower housing of the centrifugal fan according to one preferred embodiment of this invention. An angle region (A) starts from the tongue portion 140 and ends at a terminal end 210 of the flow channel wall 116. An angle region (B) is ⅓ of the angle region (A) and an angle region (C) is ⅓ of the angle region (A). The angle region (B) and angle region (C) are adjacent to each other. Thus, the angle region (B+C) is ⅔ of the angle region (A). The angle region (B) is referred as a "first pressure-enhanced section" while the angle region (C) is referred as a "second pressure-enhanced section". An angle region (D) is referred as an "air output section".

When the special structure, i.e. the convex structure, is designed on the pressure-enhanced section, it can increase the flow resistance of the air inlets so as to reduce the possibility of air-leaking through the air inlets. The special structure is preferably located within the second pressure-enhanced section.

In above-discussed embodiments, the special structure, i.e. the convex structure, is designed on the surrounding section of the pressure-enhanced section to reduce the possibility of air-leaking through the air inlets. In above-discussed embodiments, although the special structure is located on the bottom surface of the lower housing, it can also be designed on a surrounding section of the pressure-enhanced section on the upper housing. Besides, the special structure can be designed on the surrounding section of both the upper and lower housing according to the demands and budgets.

Figure 4:
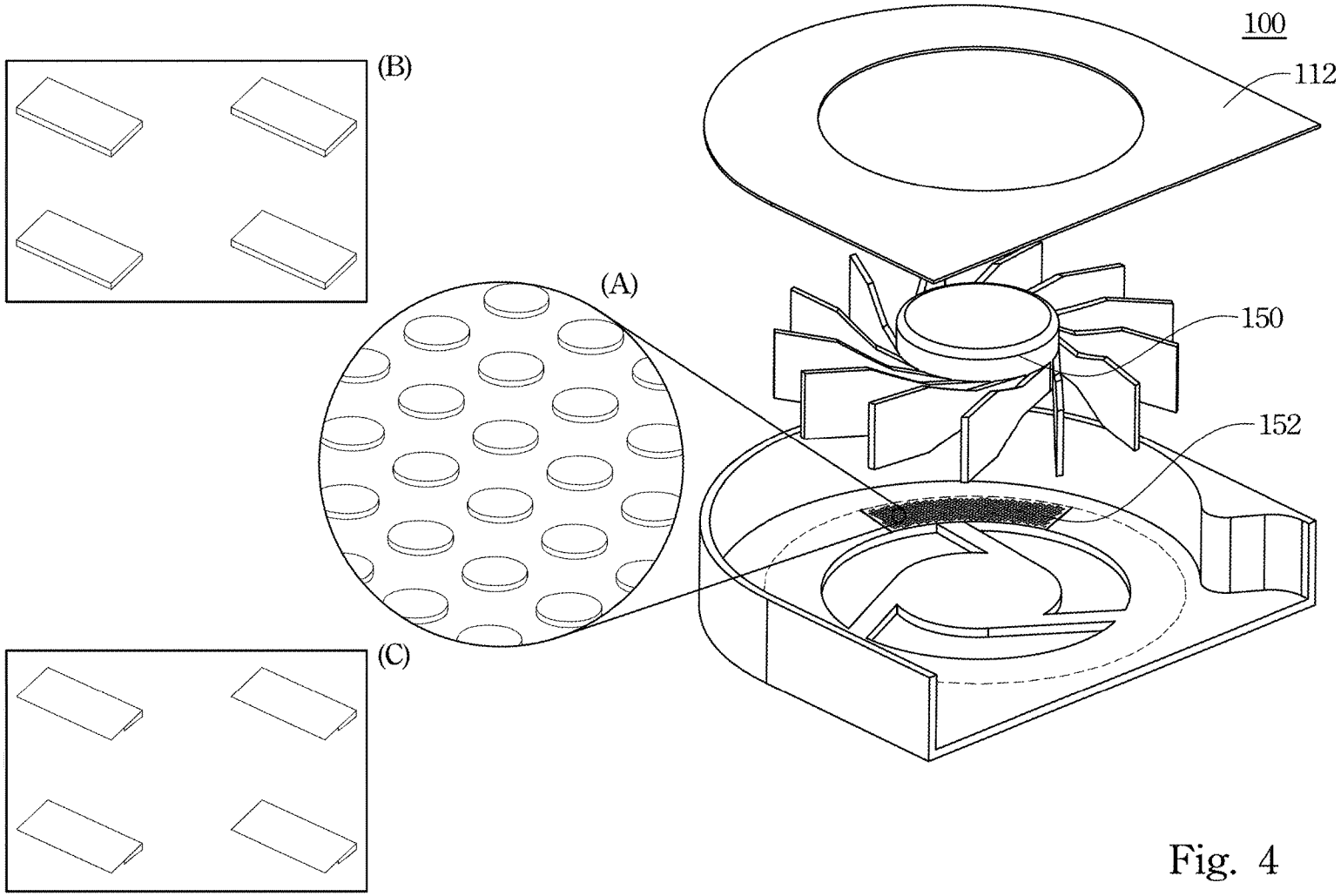
FIG. 4 illustrates a centrifugal fan and its convex structure according to one preferred embodiment of this invention.

Referring to FIG. 4, it illustrates a centrifugal fan and its convex structure according to one preferred embodiment of this invention. The convex structure 152 can be a plurality of convex members, e.g. convex members with a height less than 0.3 cm, or convex members with a height less than 1 cm. Referring to FIG. 4(A), the convex members can be circular members, which are uniformly or irregularly located on the surrounding section of the pressure-enhanced section. Referring to FIG. 4(B), the convex members can be rectangular members, which are uniformly or irregularly located on the surrounding section of the pressure-enhanced section. Referring to FIG. 4(C), the convex members can be wedged-shaped members, which are uniformly or irregularly located on the surrounding section of the pressure-enhanced section.

Figure 5:
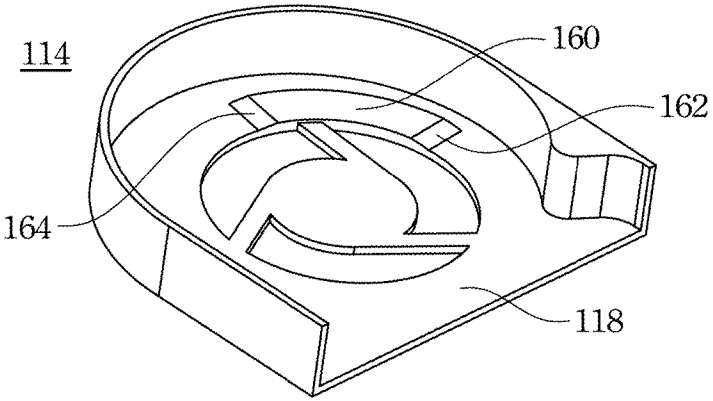
FIG. 5 illustrates a centrifugal fan and its convex structure according to another preferred embodiment of this invention.

Referring to FIG. 5, it illustrates a centrifugal fan and its convex structure according to another preferred embodiment of this invention. The convex structure 160 is a convex bulk member, which has a first inclined surface 162 and a second inclined surface 164 at two opposite sides thereof and along a rotation direction of the impeller. With this regard, when the impeller rotates, a gap between the impeller and the bottom surface 118 varies to adjust the flow resistance, thereby reducing the possibility of air-leaking through the air inlets.

Figure 6:
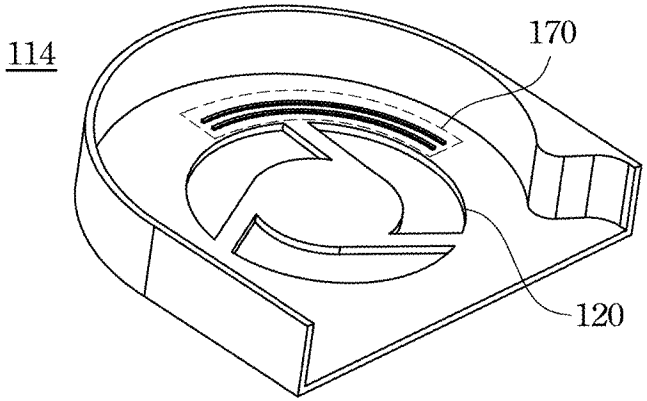
FIG. 6 illustrates a centrifugal fan and its convex structure according to still another preferred embodiment of this invention.

Referring to FIG. 6, it illustrates a centrifugal fan and its convex structure according to still another preferred embodiment of this invention. The convex structure 170 has a plurality of arc-shaped convex ribs that are in parallel with an outmost edge of the air inlet section 120 to adjust the flow resistance, thereby reducing the possibility of air-leaking through the air inlets.

Figure 7:
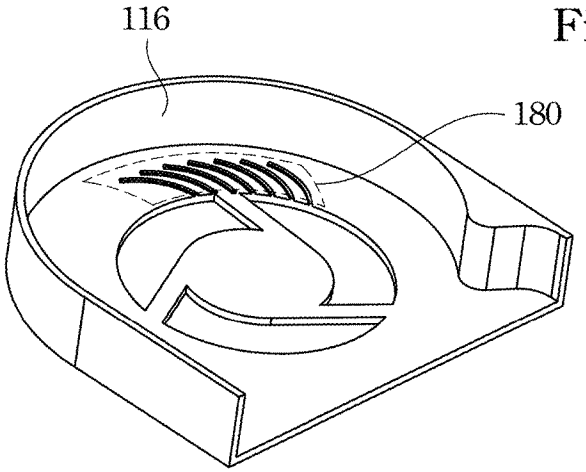
FIG. 7 illustrates a centrifugal fan and its convex structure according to still another preferred embodiment of this invention.

Referring to FIG. 7, it illustrates a centrifugal fan and its convex structure according to still another preferred embodiment of this invention. The convex structure 180 has a plurality of arc-shaped convex ribs extending radially from an outmost edge of the air inlet section 120 to guide the airflows towards the flow channel wall 116, thereby reducing the possibility of air-leaking through the air inlets.

Figure 8B:
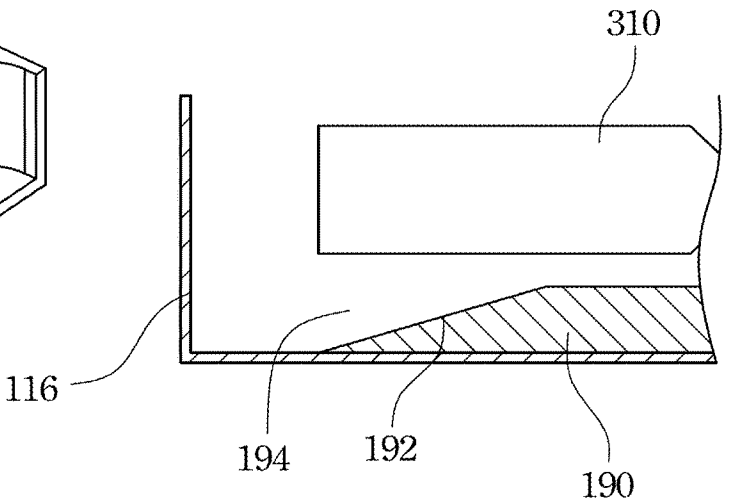
FIG. 8B illustrates a cross-sectional view taken along A-A in FIG. 8A.
Figure 8A:
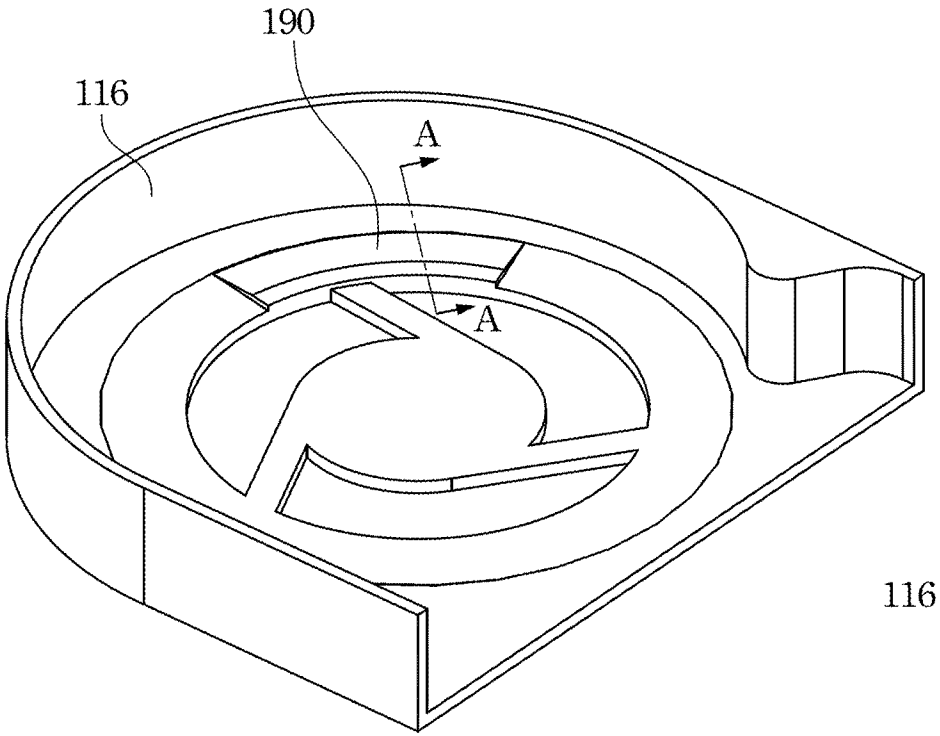
FIG. 8A illustrates a centrifugal fan and its convex structure according to still another preferred embodiment of this invention.

Referring to FIG. 8A, it illustrates a centrifugal fan and its convex structure according to still another preferred embodiment of this invention. FIG. 8B illustrates a cross-sectional view taken along A-A in FIG. 8A, wherein FIG. 8B further illustrates an impeller to easily describe this embodiment.

In this embodiment, the convex structure 190 is a convex bulk member, which has an inclined surface 192 facing the flow channel wall 116. When the impeller 310 rotates, airflows are likely trapped within the pressure-enhanced space 194 among the inclined surface 192, the blade 310 and the flow channel wall 116, thereby reducing the possibility of air-leaking through the air inlets.

In addition, the convex structure as discussed can be manufactured along with the housing, or adhered, attached to the housing after the housing has been manufactured.

According to the discussed embodiments, the centrifugal fan is equipped with the special design on the surrounding section around the air inlet section (within the housing) such that when the impeller rotates, at least two surface designs or surface roughness generate different airflow resistances. With this regard, airflows within the pressure-enhanced section of the centrifugal fan are less likely to leak through the air inlets, thereby reducing an air flowing friction of the air outlet and improving the centrifugal fan's performance, e.g. output air pressure and volume.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A centrifugal fan, comprising:

a housing comprising:

a first surface having a surrounding section and an air inlet section, the surrounding section encircling the air inlet section; and a flow channel wall defining a flow chamber and an air outlet, and at least a sidewall of the flow channel wall having a tongue portion close to the air outlet; and an impeller being rotatably connected within the flow chamber and having a plurality of blades;

wherein the surrounding section plus the air inlet section is an area on the first surface, on which the impeller is projected, the surrounding section has a pressure-increased structure protruding toward the plurality of blades and located between an outer edge of the air inlet section and an outer edge of the surrounding section, the pressure-increased structure is a convex structure comprising a plurality of circular members, a plurality of rectangular members, a plurality of wedged-shaped members, or a plurality of arc-shaped convex ribs, wherein, when at least one of the plurality of blades is circumferentially aligned with the pressure-increased structure, an axial gap is delimited by a bottom surface of the at least one of the plurality of blades and the pressure-increased structure;

wherein an angle region of a pressure-enhanced section is ⅔ of an angle region between the tongue portion and a terminal end of the flow channel wall, the angle region of the pressure-enhanced section extends starting from the tongue portion and toward the terminal end of the flow channel wall, and the entirety of the pressure-increased structure is located in the pressure-enhanced section, wherein the surrounding section comprises a first sub-section corresponding in location to the angle region between the tongue portion and the terminal end of the flow channel wall, and a second sub-section that is directly opposite the air outlet, and the entirety of the pressure-increased structure is formed in the first sub-section of the surrounding section.

2. The centrifugal fan of claim 1, wherein the angle region of the pressure-enhanced section is divided into a first part that extends starting from the tongue portion a distance that is ⅓ the angle region between the tongue portion and the terminal end of the flow channel wall, and a second part that extends starting from an end of the first part farthest from the tongue portion a distance that is ⅓ the angle region between the tongue portion and the terminal end of the flow channel wall, and the entirety of the pressure-increased structure is located in the second part of the angle region of the pressure-enhanced section.

3. The centrifugal fan of claim 1, wherein the outer edge of the surrounding section is spaced apart from the flow channel wall.

* * * * *